US005490642A

United States Patent [19]

Schwartz et al.

[11] Patent Number: 5,490,642

[45] Date of Patent: Feb. 13, 1996

[54] MANUAL TAPE DISPENSING APPARATUS

[75] Inventors: Mark E. Schwartz, Mahtomedi; Raymond D. Zachrison, Lindstrom, both of Minn.

[73] Assignee: Minnesota Mining and Manufacturing Company, Saint Paul, Minn.

[21] Appl. No.: 378,770

[22] Filed: Jan. 26, 1995

Related U.S. Application Data

[63] Continuation of Ser. No. 44,950, Apr. 9, 1993, abandoned.

[51] Int. Cl.[6] ..... B32B 31/00

[52] U.S. Cl. ..... 242/588

[58] Field of Search ..... 242/96, 99, 75.2, 242/84.8, 151, 152, 75.4, 588; 156/579

[56] References Cited

U.S. PATENT DOCUMENTS

| | | | |
|---|---|---|---|
| 1,177,636 | 4/1916 | Kuehn | 242/75.2 |
| 1,348,079 | 7/1920 | Bir | 242/96 |
| 2,023,147 | 12/1932 | Petskeyes | 93/2 |

(List continued on next page.)

FOREIGN PATENT DOCUMENTS

| | | |
|---|---|---|
| 0246659A1 | 11/1987 | European Pat. Off. . |
| 0246659 | 11/1987 | European Pat. Off. . |
| 0433718A1 | 6/1991 | European Pat. Off. . |
| 3200220A1 | 7/1983 | Germany . |
| 3409117A1 | 9/1985 | Germany . |
| 2083002 | 3/1982 | United Kingdom . |
| 2109772 | 6/1983 | United Kingdom . |
| WO89/00968 | 2/1989 | WIPO . |

OTHER PUBLICATIONS

*Scotch™ H–131 One–Hand Filament Tape Applicator, Model 27300,* 3M Brochure No. 34–7004–7176–5(J32.25)R2, 3M 1992.

*Scotch™ H–140 Filament Tape Pallet Unitizing Dispenser,* 3M Brochure No. 34–7004–7183–1(E42.15)R, 3M 1992.

*Scotch™ H–120 Filament Tape Hand Dispenser,* 3M Brochure No. 34–7004–7082–5(F932.5)R2, 3M 1993.

*Scotch™ H–130 Filament Tape Hand Dispenser,* 3M Brochure No. 34–7004–7060–1(H43.3)R2, 3M 1991.

*Scotch™ Filament Tape Hand Dispensers (H–10),* 3M Brochure No. 34–7004–7320–9(33.5)R1.

*Scotch™ H–133 One–Hand Filament Tape Applicator, Model 27800,* 3M Brochure No. 34–7004–7232–6(G81.8)R1, 3M 1991.

*Scotch™ Box Sealer Tape Hand Dispensers (H–122),* 3M Brochure No. 34–7004–7321–7(63.5)R1.

*Scotch™ H–181 Hand Dispenser, Model 18800,* 3M Brochure No. 34–7004–7438–9(B110.1)R1 (BL–vfl113–2381), 3M 1990.

Translation of an article from the German Trade Journal PACK REPORT, May 1991, pp. 98–99.

3M Brochure 75–3465–9433–8 "Stretch Laminator".

Rand Brochure.

*Primary Examiner*—John P. Darling

*Attorney, Agent, or Firm*—Gary L. Griswold; Walter N. Kirn; Mark W. Binder

[57] ABSTRACT

A portable manual tape dispensing apparatus for use for with a roll of stretchable adhesive tape. Preferably, the tape is of the type that progressively detackifies when stretched. The apparatus also preferably has a hub configured to be manually gripped by an operator. The hub includes a substantially annular surface with dimensions such that the annular surface can be slidably received within an interior of the roll of tape to securely hold the roll of tape. A stretching surface is connected to the hub so the operator may selectively orient the dispensing apparatus in either a stretching position or an unstretching position. The stretching surface contacts a portion of the tape when the apparatus is in the stretching position such that the operator can dispense the tape in a stretched detackified condition.

11 Claims, 4 Drawing Sheets

U.S. PATENT DOCUMENTS

| | | | |
|---|---|---|---|
| 2,722,331 | 11/1955 | Vogt | 216/33 |
| 2,909,301 | 5/1956 | Fritzinger | 216/29 |
| 2,972,843 | 2/1961 | De Broff | 53/74 |
| 3,839,122 | 10/1974 | Current et al. | 156/351 |
| 3,910,005 | 10/1975 | Thimon et al. | 53/3 |
| 3,930,442 | 1/1976 | Buttner | 100/18 |
| 3,944,161 | 3/1976 | Kauf | 242/96 |
| 3,972,769 | 8/1976 | Lissoni | 156/579 X |
| 4,050,221 | 9/1977 | Lancaster, III et al. | 53/211 |
| 4,093,138 | 6/1978 | Shafer | 242/75.2 X |
| 4,095,395 | 6/1978 | Goldstein | 53/198 R |
| 4,102,513 | 7/1978 | Guard . | |
| 4,109,445 | 8/1978 | Shulman | 53/198 R |
| 4,204,377 | 5/1980 | Lancaster et al. | 53/399 |
| 4,209,961 | 7/1980 | Dannelley | 53/588 |
| 4,230,519 | 10/1980 | DuBroff | 156/468 |
| 4,235,062 | 11/1980 | Lancaster, III et al. | 53/399 |
| 4,255,918 | 3/1981 | Lancaster et al. | 53/556 |
| 4,271,657 | 6/1981 | Lancaster, III et al. | 53/399 |
| 4,364,787 | 12/1982 | Radzins | 156/164 |
| 4,369,614 | 1/1983 | Tetzner | 53/566 |
| 4,429,514 | 2/1984 | Lancaster et al. | 53/556 |
| 4,432,185 | 2/1984 | Geisinger | 53/138 R |
| 4,458,467 | 7/1984 | Shulman et al. | 53/399 |
| 4,522,348 | 6/1985 | Strout et al. | 242/96 |
| 4,549,388 | 10/1985 | Lancaster | 53/556 |
| 4,563,863 | 1/1986 | Humphrey | 53/556 |
| 4,667,891 | 5/1987 | Pool | 242/75.4 |
| 4,671,043 | 6/1987 | Forni et al. | 53/399 |
| 4,676,048 | 6/1987 | Lancaster et al. | 53/399 |
| 4,693,060 | 9/1987 | Born | 53/588 |
| 4,807,427 | 2/1989 | Casteel et al. | 53/556 |
| 4,845,920 | 7/1989 | Lancaster | 53/399 |
| 4,884,385 | 12/1989 | Mushinski et al. | 53/399 |
| 4,905,451 | 3/1990 | Jaconelli et al. | 53/410 |
| 4,905,455 | 3/1990 | Horner | 53/441 |
| 4,915,767 | 4/1990 | Rajala et al. | 156/440 |
| 4,955,181 | 9/1990 | Casteel | 53/556 |
| 4,991,381 | 2/1991 | Simons | 53/556 |
| 4,995,224 | 2/1991 | Yourgalite et al. | 53/540 |
| 5,003,752 | 4/1991 | Matsumoto | 53/399 |
| 5,040,358 | 8/1991 | Thimon | 53/556 |
| 5,049,229 | 9/1991 | Czech | 156/579 X |
| 5,164,038 | 11/1992 | Sundqvist | 242/75.4 X |
| 5,174,850 | 12/1992 | Stefan | 156/579 X |
| 5,178,717 | 1/1993 | Rodriguez | 156/579 X |
| 5,216,871 | 6/1993 | Hannen | 53/556 |
| 5,236,540 | 8/1993 | Shi | 156/579 X |
| 5,269,871 | 12/1993 | Longworth et al. | 156/579 X |

MANUAL TAPE DISPENSING APPARATUS

This is a continuation of application Ser. No. 08/044,950 filed Apr. 9, 1993, now abandoned.

REFERENCE TO CO-PENDING APPLICATION

Reference is made to patent application Ser. No. 08/045,9856 entitled MANUAL TAPE DISPENSING APPARATUS filed on even date herewith, which has been abandoned in favor of a continuation application Ser. No. 08/158,137, filed under 37 CFR § 1.62.

BACKGROUND OF THE INVENTION

This invention relates to a tape dispensing device and more specifically, to a manual, portable dispensing apparatus for use with a roll of stretchable adhesive tape.

A number of manufacturing and distribution settings typically require that packages or products be grouped together to facilitate the handling, loading, shipping and storage of the packages or products. The grouping of these products is commonly known as "unitizing".

There are a number of methods which unitize products. One such method is palletization, which generally involves placing a number of boxed items on a pallet in a cube or other rectangular array. Normally the array of boxed items are strapped or wrapped to the pallet to ensure the lateral stability of the array during the shipping and loading of the pallet. "Bundling" is another unitizing method which generally involves strapping or wrapping a number of products together. A number of other unitizing methods also require the use of either a strapping or wrapping material.

Recently an adhesive tape was developed to provide an efficient way to strap products and packages. A description of this adhesive tape is provided in Assignee's co-pending U.S. application Ser. No. 07/802,061, filed Dec. 10, 1992, which is a Continuation-in-Part of Assignee's abandoned U.S. application Ser. No. 07/632,173, filed Dec. 20, 1990; Assignee's co-pending U.S. application Ser. No. 07/731,341, filed on Jul. 19, 1991; and Assignee's co-pending U.S. application Ser. No. 07/892,220, filed on Jun. 2, 1992, all of which are fully incorporated herein by reference thereto. The adhesive tape is stretchable and is comprised of a highly extensible, substantially non-recoverable backing which has a layer of pressure sensitive adhesive on at least one of its surfaces. The pressure sensitive adhesive has sufficient shear strength and adhesive holding power to adhere to small regions of the objects to which the unstretched tape is attached. This adhesive property of the tape, however, is greatly reduced when the tape is stretched or elongated to several times its original length, for example 600–800%. Essentially the tape becomes "detackified" when the tape is elongated. This detackification is beneficial because it greatly reduces the damage that the adhesive could cause to an object surrounded by the tape when the tape is removed from the object.

The elongation of the tape provides other important benefits beyond inducing detackification. First, the tensile strength of the tape increases when the tape is elongated. Accordingly, the tape can be used in strapping methods which require a high tensile strength strap. Secondly, the elongation of the tape reduces the quantity of tape that is needed for a given unitizing application, thereby reducing the cost of each application. Furthermore, the amount of material which must be recycled or placed in a landfill is also reduced.

The stretchable adhesive tape has proven to be useful in a variety of unitizing procedures. For example, the tape can easily be incorporated to strap an array of objects on a pallet. First, an unstretched tackified portion of the tape is applied to a first object. Once secured, the tape is stretched to induce detackification and wrapped around the remaining objects. Finally, a portion of unstretched tape is adhered to an object in the group to anchor the stretched detackified tape. As applied above, the tape provides stability to the objects during the shipping and handling of the pallet. The tape can easily be removed from the pallet when the pallet reaches it's destination by merely releasing the adhering portions of the tape from the object(s). A more detailed description of a palletization method like the one described above is provided in Assignee's above-referenced co-pending U.S. application Ser. No. 07/731,341, filed on Jul. 19, 1991.

A detailed description of an automatic machine that utilizes the stretchable adhesive tape to palletize objects is disclosed in Assignee's above-referenced co-pending U.S. application Ser. No. 07/892,220, filed on Jun. 2, 1992. The unitizing machine has a rotating turntable upon which an array of objects are stacked. A taping head is located adjacent the turntable and is connected to a vertical movement means such that the taping head can be moved vertically with respect to the array of objects. The taping head advances the tape through a stretch station and feeds the tape to the array of objects. A programmable controller simultaneously controls, among other things, the amount of stretch performed by the taping head, the vertical motion of the taping head, and the rotation of the turntable to palletize the array of objects.

The automatic machine, however, is not readily portable and cannot be manually manipulated to wrap a variety of objects. Accordingly, it maybe difficult to utilize the automatic machine in a number of unitizing procedures. In addition, the automatic machine may be prohibitively expensive for a user that performs a relatively small number of palletization procedures.

There are a number of other devices that dispense materials in a stretched condition. U.S. Pat. No. 4,429,514 to Lancaster et al. discloses one such device designed in part to stretch a film of material used in a wrapping process. In Lancaster et al., object(s) are placed within the confines of an apparatus and an arm is vertically revolved around the object(s). An upstream roller, a downstream roller, and a drive member are attached to the arm. The arm has a manual gravity switch that includes a spring to bias the downstream roller member together with the drive member when the arm is rotating vertically upward around the object(s). The upstream roller is driven at a slower speed than the downstream roller when the downstream roller is biased against the drive member. Therefore, the film is stretched between the downstream roller and the upstream roller when the arm is rotated vertically upward. The film is stretched so that it places a compressive force upon the object(s) contained in the film.

The stretch film usable with the device in Lancaster et al. is designed to completely wrap or "cocoon" objects, whereas stretchable adhesive tape contacts discreet portions of each object. Accordingly, a stretch film unitizing procedure requires the use of a substantial amount of material. In addition, separate means for adhering the stretch film to the object is required because the stretch film has no inherent adhesive means. In addition, the device of Lancaster et al. is not readily portable and is somewhat cumbersome to use.

Stretchable adhesive tape can be utilized in a large variety of packaging procedures. Therefore, it can be seen that there is a need for a portable manual tape dispensing apparatus for use with a stretchable adhesive tape such as of the type that detackifies when stretched. The apparatus should be sufficiently small and easy to use to enable an operator to manipulate the apparatus about a variety of packages or objects.

SUMMARY OF THE INVENTION

The present invention is a portable manual tape dispensing apparatus for dispensing and applying stretchable adhesive tape selectively in either a stretched or an unstretched state. The tape is preferably of the type that progressively detackifies when stretched. The apparatus includes a hub that has a substantially annular surface with dimensions such that the annular surface can be slidably received within an interior of the roll of tape to securely hold the roll of tape. A handle means is also provided for permitting the apparatus to be manually grasped and controlled by an operator. Preferably, the hub is configured with such a handle. A stretching surface is connected to the hub so the operator may selectively orient the dispensing apparatus in either a stretching position or an unstretching position. The stretching surface contacts a proximal portion of the tape when the apparatus is in the stretching position such that the operator can dispense the tape in a stretched condition.

In one embodiment, the stretching surface is disposed on a pivot arm that is preferably directly pivotally connected to the hub. Preferably, the operator obtains the stretching position from a non-stretching position by rotating the apparatus approximately 5° to 30°. The pivot arm also advantageously provides a compression surface that is disposed on the pivot arm adjacent to the stretching surface. The compression surface can be used to direct a compressive force to the roll of tape to inhibit the roll of tape from rotating freely about the annular surface when the operator stretches the distal portion of the tape.

In another embodiment, the stretching surface is disposed on a generally cylindrical rod that is operatively fixedly positioned relative to the hub. The stretching surface of the rod is further preferably disposed adjacent to a free rolling member. Preferably, the operator obtains the stretching position from a non-stretching position by rotating the apparatus approximately 60° to 80°.

The present invention provides a means for utilizing the stretchable adhesive tape in a number of applications. The apparatus is portable and sufficiently small to enable an operator to manipulate the apparatus by using the operator's hands. The apparatus provides a simple, manually operative means for selectively dispensing the tape in a stretched condition.

DETAILED DESCRIPTION OF THE PREFERRED EMBODIMENTS

Figure 1:
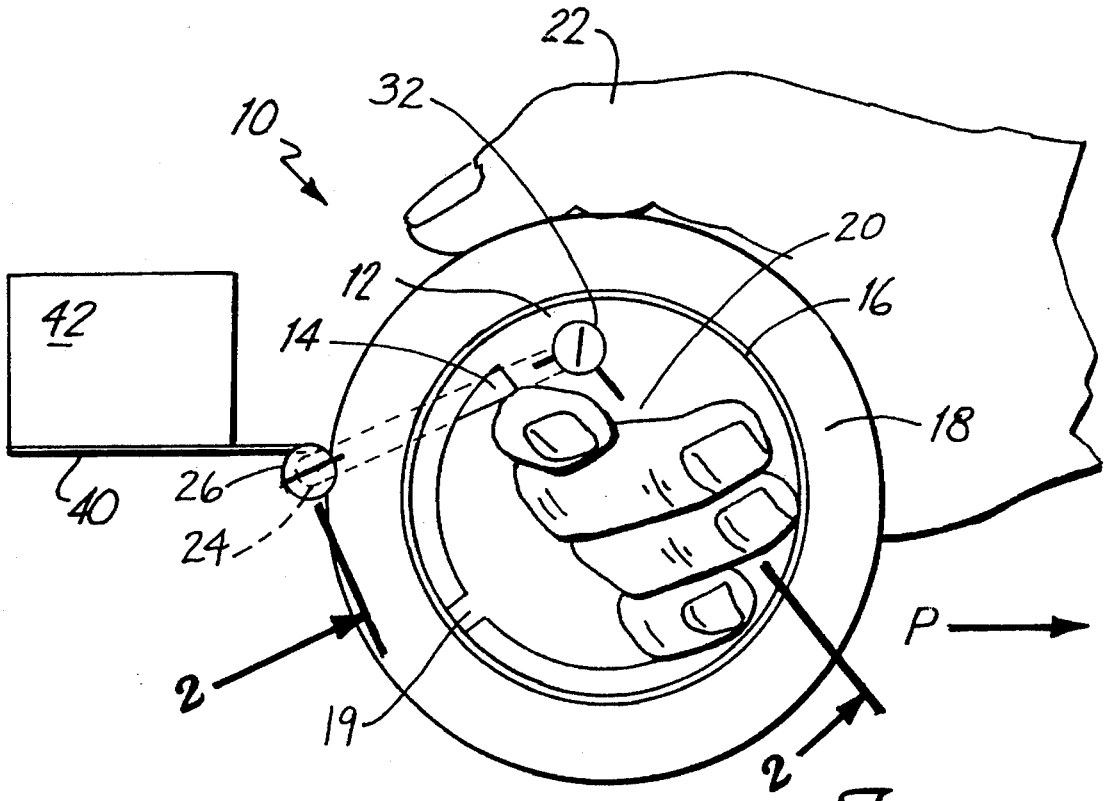
FIG. 1 is a side elevational view of the present invention in its nonstretching position.

FIG. 1 shows a dispensing apparatus 10 having a resilient hub 12 and a stretching member 14. The resilient hub 12 preferably has a cutout section 19 that allows the resilient hub 12 to flex upon manual manipulation so that the hub 12 can be slidably received within and removed from an interior member 16 of a roll of stretchable adhesive tape 18. A handle portion 20 is preferably disposed within the hub 12 so the apparatus 10 can be manually gripped by an operator's hand 22. It is understood that the handle portion could as easily be provided outside of the tape roll and operatively associated with the hub 12. The hub 12 is configured such that only a slight biasing force is directed to the interior member 16. Therefore, the roll of stretchable adhesive tape 18 rotates relatively freely about the hub 12. However, if desired, resilient hub 12 can be configured to provide a larger biasing force to the interior member 16 so that the roll of tape 18 rotates with a greater resistance about the hub member 12.

Figure 2:
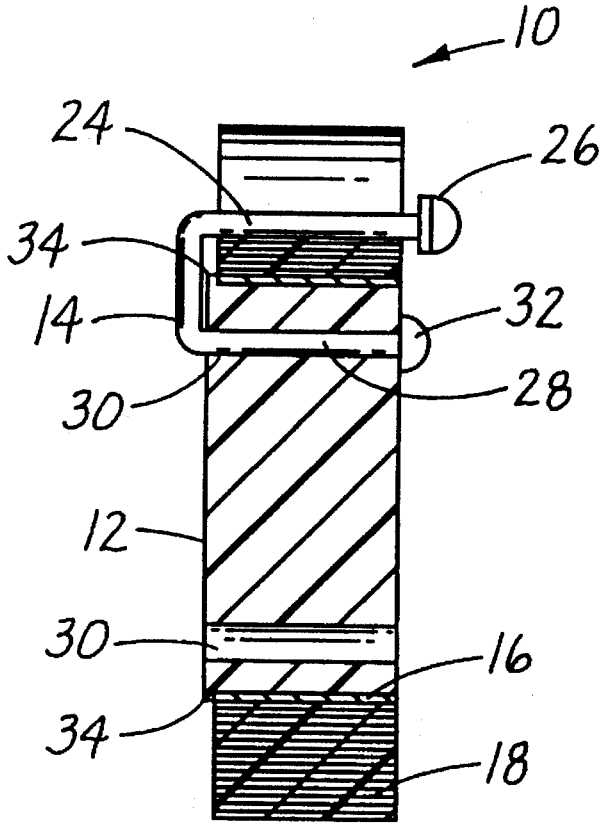
FIG. 2 is a sectional view as taken generally along line 2—2 of FIG. 1.

As seen in FIG. 2, the stretching member 14 is a pivot arm that has a stretching portion 24, a containing head 26, and an attachment portion 28. The stretching member 14 is preferably directly pivotally connected to the hub 12 by way of the attachment portion 28 that is configured to be slidably received within a cylindrical bore 30 disposed within the hub 12. The attachment portion 28 is adapted to receive a stretching member screw 32 to secure the stretching member 14 to the hub 12.

As seen best in FIG. 2, a containing ridge 34 is also preferably disposed about the circumference of the hub 12. The containing ridge 34 and the containing head 26 of the stretching member 14 together hold the roll of tape 18 on the hub 12 when the operator manipulates the apparatus 10. An operator can laterally install or remove the roll of tape 18 onto or from the hub 12 by simply pivoting the stretching member 14 such that the containing head 26 will not contact the roll 18.

The following describes how the operator can utilize the apparatus 10 with the roll of stretchable adhesive tape 18. FIG. 1 shows the apparatus 10 in a non-stretching position. As seen in FIG. 1, the stretching portion 24 imparts a minimal amount of frictional forces upon the tape 18 as it is dispensed from the apparatus 10. Therefore, the operator can remove the tape 18 from the apparatus in an unstretched condition. Accordingly, FIG. 1 shows a leading portion of unstretched tackified tape 40 that has been dispensed from the apparatus 10 and adhered to an object 42 (not necessarily shown to scale).

Figure 3:
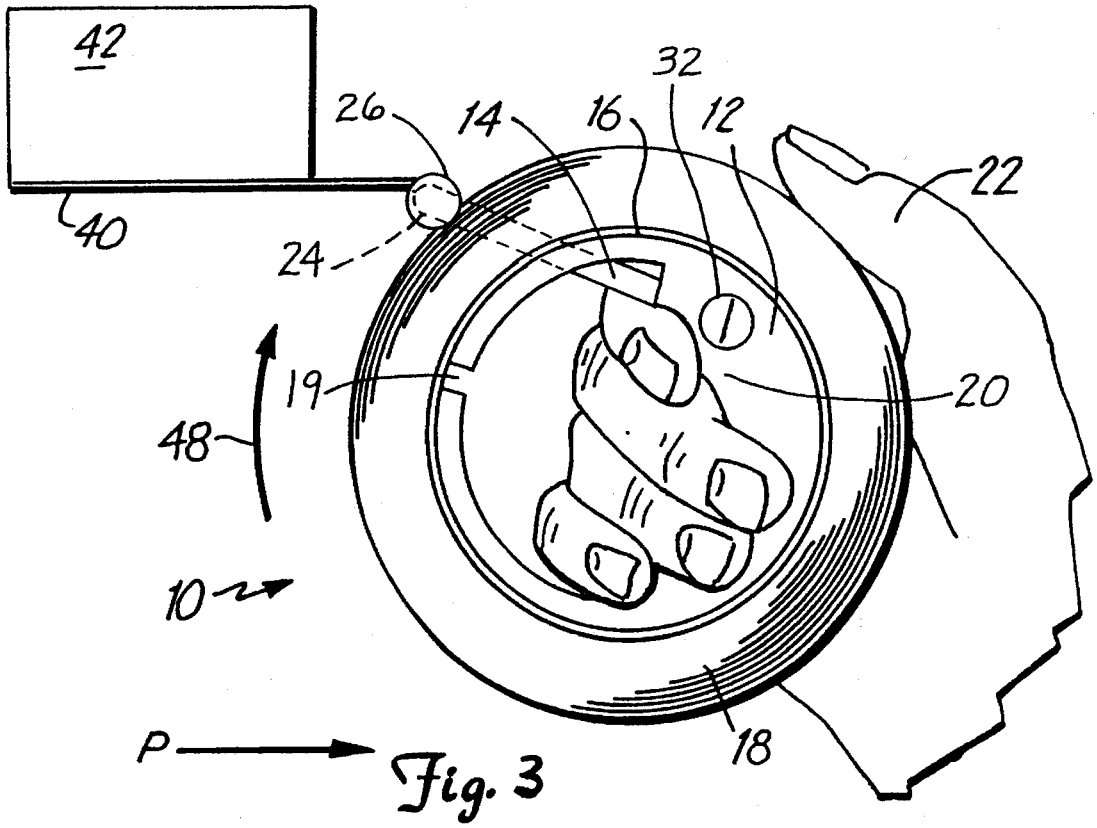
FIG. 3 is a side elevational view of the present invention in its stretching position.
Figure 4:
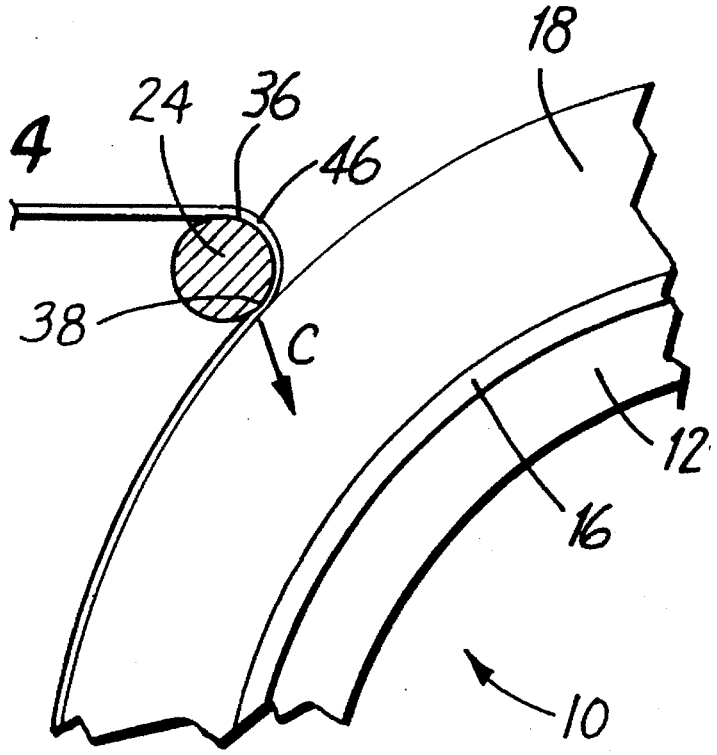
FIG. 4 is an enlarged side elevational view of the present invention with a portion of the apparatus removed.

FIGS. 3 and 4 show how the operator can dispense the tape 18 from the apparatus 10 in a stretched condition. To obtain the stretching position shown in FIG. 3, the operator simply rotates the apparatus 10 in a clockwise direction 48, approximately 5° to 30° from the nonstretching position shown in FIG. 1. It is understood that the degree of rotation about the axis of the hub 12 is dependent on the position of the pivotal connection of the stretching member 14 to the axis of the hub 12 and the contact position of the stretching portion 24 to the roll of tape 18.

FIG. 4 more clearly shows the stretching portion 24 of the stretching member 14 when the apparatus 10 is in the stretching position. The containing head 26 has been cut away in FIG. 4 for purposes of clarity. The stretching portion 24 is preferably generally cylindrical in shape and includes a stretching surface 36 and a compression surface 38. As seen in FIG. 4, a proximal portion of tape 46 wraps about the stretching surface 36 and the compression surface 38 when the apparatus 10 is in the stretching position. This wrapping affect increases the amount of friction generated between the stretching portion 24 and the proximal portion of tape 46 when the operator pulls the apparatus 10 in a direction P, see FIG. 3. Moreover, the stretching is effectively controlled by the stretching surface 36 to occur immediately downstream of the stretching surface 36. In addition, since the stretching member 14 is freely pivotal, tensile forces that are formed within the tape 18 advantageously cause the stretching member 14 to pivot about the hub 12 and against the roll 18 when the operator pulls the apparatus 10 in the direction P. This creates the compression surface 38 and, therefore, the compression surface 38 directs a compressive force C onto the roll of tape 18. The compressive force C increases the amount of friction between the proximal portion of tape 46 and the compression surface 38. The compressive force C also elevates the amount of friction between the interior member 16 and the hub 12 such that the roll of tape 18 does not roll as freely around the hub 12. Accordingly, the compressive force C limits the amount of tape dispensed from the roll 18 when the apparatus 10 is in the stretching position.

The compressive force C in combination with the frictional forces formed between the proximal portion of tape 46 and stretching portion 24 permit the operator to dispense the tape in a stretched detackified condition. The operator can adjust the amount of elongation caused by the stretching portion 24 by increasing or decreasing the amount of tape 18 wrapped around the stretching portion 24 by varying the angle of application.

Preferably, the operator should manipulate the apparatus 10 such that the tape 18 is elongated 600–800% when it is dispensed. This particular range of elongation provides the best characteristics of resiliency, tensile strength, and detackification of the tape described in Assignee's above-referenced copending U.S. Applications.

The amount of tape 18 that is wrapped around the stretching portion 24 to obtain the preferred amount of stretch is dependent upon a number of factors, including the thickness of the tape's backing and/or the climate within which the tape is being stretched (i.e. temperature and humidity). It has been found that the apparatus disclosed above should be rotated approximately 5° to 30° from its nonstretching position to obtain the appropriate amount of stretch when the tape is applied in an ambient room and the tape has a backing having a thickness of 0.005 inches. One skilled in the art will recognize, however, that the amount of rotation can be easily adjusted to obtain the appropriate elongation for a variety of tape sizes and/or climates.

After wrapping the object(s) with the elongated tape, the operator can rotate the apparatus into the nonstretching position shown in FIG. 1. This permits the operator to remove a downstream portion of tape (not shown) in an unstretched condition from the dispensing apparatus 10. The operator then removes the portion of tape extending from the apparatus 10 so that the operator can adhere the downstream portion of tape to an object to complete the unitizing/packaging procedure.

Figure 5:
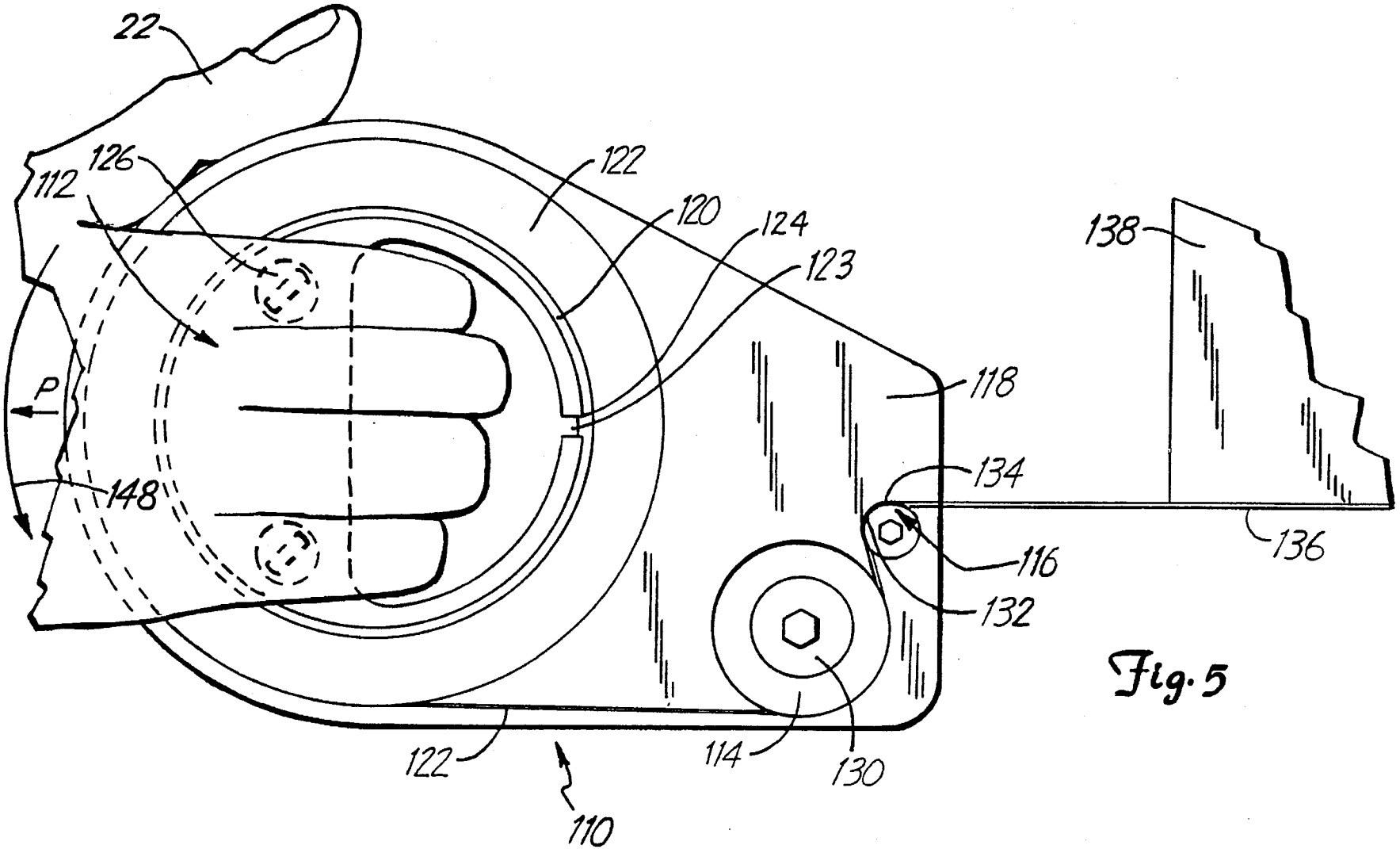
FIG. 5 is a side elevational view of an alternative embodiment of the present invention shown in its nonstretching position.
Figure 6:
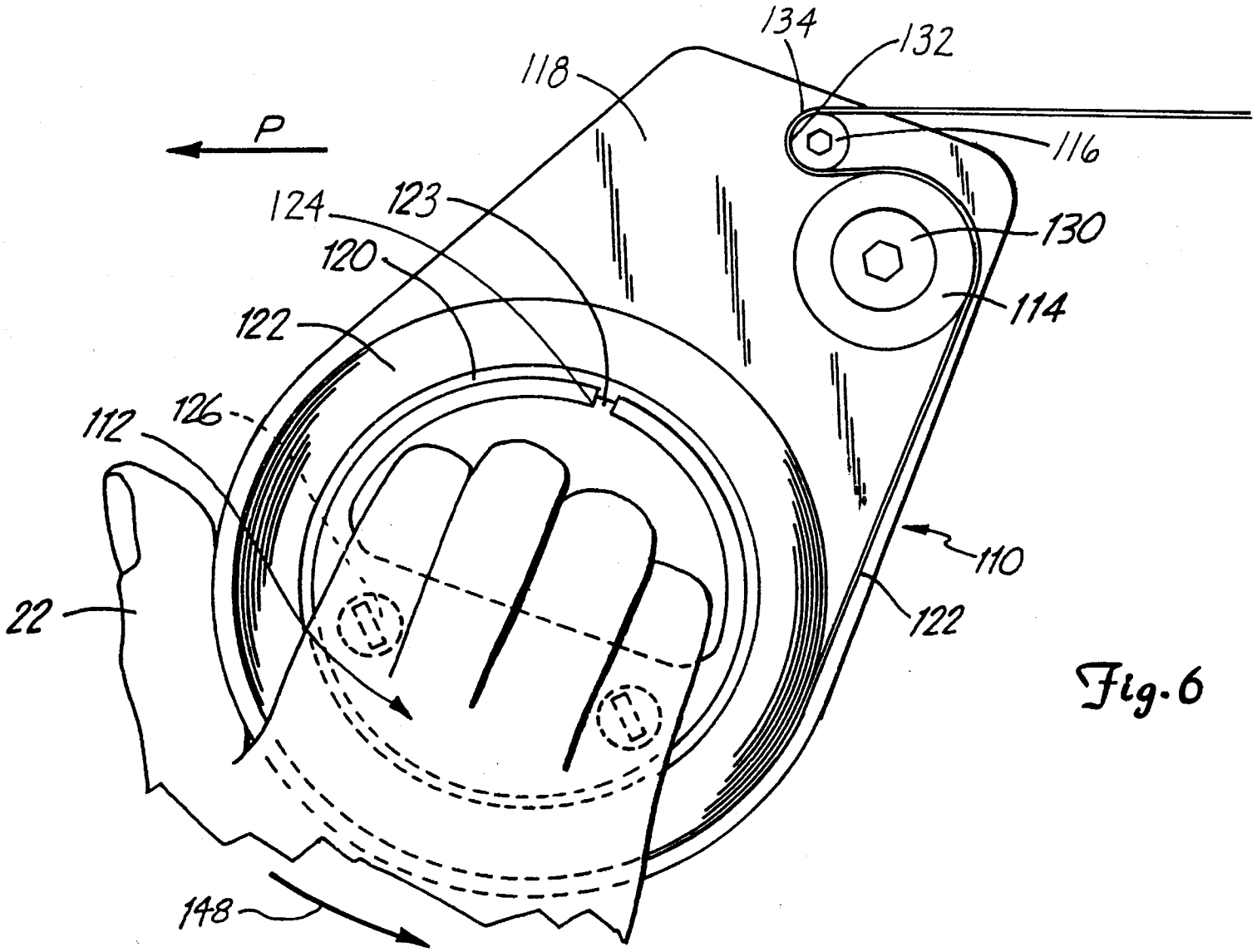
FIG. 6 shows a side elevational view of the alternative embodiment of FIG. 5 in its stretching position.

FIGS. 5–6 show an alternative embodiment of the present invention comprising a dispensing apparatus 110 including a hub 112 and a stretching member 116 fixedly operatively positioned relative to the hub 112 by way of a base plate 118. The hub 112 is also preferably provided with a handle configuration, as in the above-described embodiment. The hub 112 is preferably sufficiently resilient and has a cutout section 123 that allows the hub 112 to be flexed by manual manipulation so that the hub 112 can be slidably received within and removed from an interior member 120 of a roll of stretchable adhesive tape 122. The resilient hub 112 preferably provides only a slight biasing force that is directed to the interior member 120. Therefore, the roll of tape 122 rotates relatively freely about the handle member 112. However, if desired, resilient hub 112 can be configured to provide a larger biasing force to the interior member 120 so that the roll of tape 122 rotates with a greater resistance about the hub 112. A containing ridge 124 is also preferably disposed about the circumference of the handle member 112 to prevent the roll of tape 122 from being inadvertently laterally removed from the hub 112.

The stretching member 116 is preferably a generally cylindrical stationary surface attached to the base plate 118. It is understood that many other shaped surfaces are usable. An idle roller 114 is additionally preferably disposed adjacent to the stretching member 116 for controlling overwrapping of the tape over the stretching member 116, as will be more clearly understood from the description below. The idle roller 114 rotates freely about an idle roller pin 130 which is connected to the base plate 118.

The following describes how the apparatus 110 is utilized with the roll of stretchable adhesive tape 122. FIG. 5 shows the apparatus 110 in a nonstretching position. The stretching member 116 contacts the tape 122 as it extends from the apparatus. The idle roller 114 is positioned such that a stretching surface 132 disposed on the stretching member 116 contacts a proximal portion of tape 134 when the apparatus 110 is in the stretching position. However, as seen in FIG. 5, the stretching member 116 imparts a minimal amount of frictional forces upon the tape 122 as it is dispensed from the apparatus 110. Therefore, the operator can remove the tape 122 from the apparatus 110 in an unstretched condition. Accordingly, FIG. 5 shows a leading portion of unstretched tape 136 adhered to an object 138 (not necessarily shown to scale).

FIG. 6 shows how the operator can manipulate the apparatus 110 such that the operator can dispense the tape 122 in a stretched condition. As seen in FIG. 6, the apparatus has been rotated in a counter-clockwise direction 148 approximately 70°. By rotating the apparatus 110, the operator increases the amount of tape 122 that wraps about the stretching surface 132. This increased wrapping causes sufficient frictional forces to form between the proximal portion of tape 134 and the stretching surface 132 when the apparatus 110 is pulled in a direction P. Accordingly, the operator can dispense the tape 122 in a stretched condition. Moreover, the stretching is effectively controlled by the stretching surface 132 to occur immediately downstream from the stretching surface 132.

The operator should preferably manipulate the apparatus 110 such that the tape 122 is elongated 600 to 800%. It has been found that the apparatus 110 disclosed above should be rotated approximately 60° to 80° to obtain elongation within the noted range in an ambient room for a tape having a backing with a thickness of 0.006 inches. Again, it is understood that the degree of rotation about the axis of the hub 112 is dependent on the position of the stretching member 116 relative to the axis of the hub 112 and the position of the idle roller 114, or a plurality thereof, if so provided.

After wrapping the objects with the elongated tape, the operator can rotate the apparatus back to the non-stretching position (shown in FIG. 5). This permits the operator to remove a downstream portion of unstretched tape (not shown) from the apparatus 110. The operator then removes the downstream portion of tape extending from the apparatus and adheres the downstream portion to an object or objects to complete the unitizing/packaging procedure.

The dispensing apparatus 10, 110, of the present invention provides a means for utilizing the stretchable adhesive tape in a number of applications. The apparatus 10, 110 is portable and sufficiently small to enable an operator to manipulate the apparatus by using the operator's hands. In addition, the apparatus 10, 110 provides a simple, manually operative means for selectively dispensing the tape in either a stretched condition or an unstretched condition.

It is further understood that many modifications or other features could be incorporated within the above-described designs. For example, a cutting means could be easily incorporated by way of a fixed blade, movable blade or the like, or other means as appropriate.

Although the present invention has been described with reference to preferred embodiments, workers skilled in the art will recognize that changes may be made in form and detail without departing from the spirit and scope of the invention.

What is claimed is:

1. A portable manual tape stretching and dispensing apparatus for use with a roll of stretchable adhesive tape, the apparatus comprising:

a hub having a surface with dimensions such that the surface can be slidably received within an interior of the roll of tape to securely hold the roll of tape;

a handle means for manually grasping and manipulating the dispensing apparatus; and a stretching surface relative to which the tape moves and over which the tape slides during dispensing and which is operatively connected to the hub, said stretching surface for providing a frictional force against the relative sliding movement of the tape over the stretching surface during dispensing so that the operator may selectively orient the dispensing apparatus in a stretching position and an unstretching position by changing the amount of sliding contact between the stretching surface and the tape, wherein in the stretching position, the sliding contact and frictional force are greater than the sliding contact and frictional force when in the unstretching position as caused by the change in orientation.

2. The apparatus of claim 1 wherein the stretching surface is disposed on a pivot arm pivotally connected to the hub.

3. The apparatus of claim 2 wherein the apparatus is changed between the stretching position and the unstretching position by rotating the apparatus.

4. The apparatus of claim 3 wherein the apparatus is changed between the stretching position and the unstretching position by rotating the apparatus approximately 5° to 30°.

5. The apparatus of claim 2 further comprising a compression surface disposed on the pivot arm adjacent the stretching surface so the compression surface directs a compressive force to the roll of tape to inhibit the roll of tape from rotating freely about the hub when the operator dispenses the tape in a stretched condition.

6. The apparatus of claim 5 wherein frictional forces are generated between the compression surface and the proximal portion of tape when the operator dispenses the tape in a stretched condition.

7. The apparatus of claim 1 further comprising a free-rolling member disposed adjacent the stretching surface.

8. The apparatus of claim 7 wherein the stretching surface is disposed on a generally cylindrical rod.

9. The apparatus of claim 8 wherein the cylindrical rod is positioned so that the apparatus is changed between the stretching position and the unstretching position by rotating the apparatus.

10. The apparatus of claim 7 wherein the apparatus is changed between the stretching position and the unstretching position by rotating the apparatus approximately 60° to 80°.

11. The apparatus of claim 1, wherein the hub is configured to be manually gripped by an operator to comprise the handle means.

* * * * *